United States Patent [19]

Matsui

[11] Patent Number: 5,012,055

[45] Date of Patent: Apr. 30, 1991

[54] SPRING LOADED PUSH-BUTTON SWITCH HAVING PREDICTABLE SWITCHING TIME DESPITE VARYING SPRING CHARACTERISTICS

[75] Inventor: Toshimasa Matsui, Iwaki, Japan

[73] Assignee: Alps Electric Co., Ltd., Tokyo, Japan

[21] Appl. No.: 435,221

[22] Filed: Nov. 9, 1989

[30] Foreign Application Priority Data

Dec. 12, 1988 [JP] Japan ..... 63-160388[U]

[51] Int. Cl.[5] ..... H01H 13/28

[52] U.S. Cl. ..... 200/408; 200/517

[58] Field of Search ..... 200/408, 525, 517

[56] References Cited

U.S. PATENT DOCUMENTS 2,708,371 5/1955 Pashby ..... 200/408 X 4,118,611 10/1978 Harris ..... 200/408

FOREIGN PATENT DOCUMENTS 66165 10/1928 Sweden ..... 200/525

1424065 9/1988 U.S.S.R. ..... 200/408

*Primary Examiner*—Renee S. Luebke

*Attorney, Agent, or Firm*—Guy W. Shoup; Brian D. Ogonowsky

[57] ABSTRACT

A push button switch including a housing, an operating member slidably received in the housing, a contact switch section located under the operating member, an actuator rotatably supported to the housing for opening and closing the contact switch section, a spring retained between the actuator and the operating member, and a pusher pin extending downwardly from the operating member and adapted to push the actuator, wherein when the operating member is depressed to make the pusher pin abut against the actuator, the actuator starts to be rotated for generation of buckling of the spring. Accordingly, the switching time of the buckling of the spring can be made constant, thereby ensuring a constant on-timing of the switch.

2 Claims, 5 Drawing Sheets

SPRING LOADED PUSH-BUTTON SWITCH HAVING PREDICTABLE SWITCHING TIME DESPITE VARYING SPRING CHARACTERISTICS

BACKGROUND OF THE INVENTION

The present invention relates to a push button switch for use with personal computers, word processors, etc., and more particularly to such a push button switch using a membrane switch for a contact switch section and providing a click feeling.

FIGS. 5A and 5B show a conventional push button switch of this kind, wherein FIG. 5A shows an undepressed condition of a key top of the push button switch, and FIG. 5B shows a depressed condition of the key top.

Referring to FIGS. 5A and 5B, the key top designated by reference numeral 1 is slidably received in a hollow cylindrical support 3 extending upright from a frame 2 of a keyboard. The frame 2 is mounted on a substrate 4 in the keyboard, and has a plurality of supports 3 corresponding to a plurality of key tops 1.

The key top 1 is fixedly provided with a stem 5 extending downwardly and slidably received in the cylindrical support 3. The stem 5 is formed with a pair of skirts 6 (one of which is shown) forked from an upper portion of the stem 5. The stem 5 is formed on its outer surface with ribs, and the cylindrical support 3 is formed on its inner surface with grooves. The ribs of the stem 5 are slidably engaged with the grooves of the cylindrical support 3 to guide the vertical travel of the key top 1 in the cylindrical support 3.

A rocking actuator 8 is located under the key top 1, and a compression coil spring 7 is interposed between the key top 1 and the actuator 8. Reference numeral 10 designates a contact switch formed in a membrane contact switch structure 9 formed on the substrate 4. The actuator 8 is adapted to be rocked by depressing the key top 1 and thereby closing the contact switch 10. An upper end of the spring 7 is engaged with a mounting base 11 formed on the inner wall surface of the stem 5. The mounting base 11 is slightly inclined so that the spring 7 may be deflected and buckled in a preselected direction (e.g., rightwardly as viewed in FIG. 5A) upon depression of the key top 1. However, the buckling of the spring 7 in a direction perpendicular to a plane of the sheet of the drawing is prevented by the skirts 6 of the stem 5.

The actuator 8 is normally urged against an upper surface 12 of the membrane contact switch structure 9 by a biasing force of the spring 7, and the key top 1 is also normally urged upwardly by the biasing force of the spring 7. A pair of stoppers 13 (one of which is shown) are formed on the outer surfaces of the skirts 6 of the stem 5 at a lower end thereof. The stoppers 13 are adapted to engage a pair of shoulders 14 (one of which is shown) formed on the inner surface of the cylindrical support 3. Thus, the upward movement of the key top 1 is restricted by the engagement of the stoppers 13 with the shoulders 14. Specifically, each of the stoppers 13 has a slant surface cooperating with a slant surface of each of the shoulders 14 for easy assembling of the key top 1 with respect to the cylindrical support 3. However, after assembling, an upper surface of each stopper 13 abuts against a lower surface of each shoulder 14 to restrict the vertical travel of the key top 1.

Under the rest condition of the actuator 8 shown in FIG. 5A, a lower surface 16 of a supporting base 15 of the actuator 8 and a lower surface 18 of another supporting base 17 of the actuator 8 are maintained in pressure contact with the upper surface 12 of the membrane contact switch structure 9. The lower surfaces 16 and 18 are separate from the contact switch 10 so as not to apply a force to the contact switch 10 even by the compression of the spring 7. Under the rest condition, there is defined a small gap between a lower surface 21 of a projecting portion 20 of the actuator 8 and the upper surface 12 of the membrane contact switch structure 9.

The membrane contact switch structure 9 includes an upper layer 22, an intermediate layer 23 and a lower layer 24. The intermediate layer 23 has a plurality of circular openings 29 (one of which is shown) for providing a plurality of the contact switches 10 therein, respectively. Each of the contact switches 10 is comprised of an upper circular contact 26 formed on a lower surface 25 of the upper layer 22 and a lower circular contact 28 formed on an upper surface 27 of the lower layer 24. With this structure, when the upper layer 22 is depressed by the actuator 8 upon rocking thereof, the upper circular contact 26 is brought into electrical contact with the lower circular contact 28, thus closing the contact switch 10.

In operation, when the key top 1 is depressed from its rest position, a depression force applied to the key top 1 is transmitted through the coil spring 7 to the actuator 8, and there is generated a counterclockwise moment about pivot points 30 and 31. Thereafter, when the depression force is gradually increased, the coil spring 7 is further compressed and is simultaneously deflected rightwardly as viewed in FIG. 5B. As a result, there is generated a clockwise moment about the pivot points 30 and 31 by the lateral (rightward) deflection of the coil spring 7. Finally, when the clockwise moment exceeds the counterclockwise moment, the actuator 8 is rocked clockwise about the pivot points 30 and 31 as shown in FIG. 5B. As a result, the lower surface 21 of the projecting portion 20 of the actuator 8 is brought into pressure contact at point 32 with the upper surface 12 of the membrane contact switch structure 9 to thereby depress the upper circular contact 26 against the lower circular contact 28. Thus, the contact switch 10 is closed. At this time, the buckling of the coil spring 7 is generated to obtain a click feeling.

In the prior art switch as mentioned above, the actuator 8 is rocked by the compression and the buckling of the coil spring 7 retained between the key top 1 and the actuator 8, and the contact switch 10 is turned on by the depression of the actuator 8 against the upper circular contact 26. Accordingly, the time between key depression and electrical contact at the contact switch 10 ("on-timing") is affected by variations of the spring force of the coil spring 7. Furthermore, when the key top 1 is depressed at its edge, the stem 5 is inclined because of the existence of an annular clearance between the cylindrical support 3 and the stem 5, causing fluctuation in the time between the key depression and the buckling of the coil spring 7 ("start-timing"). In some cases, the actuator 8 is not rocked because of fluctuation of the depression force.

SUMMARY OF THE INVENTION

It is an object of the present invention to provide a push button switch which may provide a constant start-timing to thereby ensure a constant on-timing of the switch.

According to the present invention, there is provided a push button switch comprising a housing, an operating member slidably received in said housing, a contact switch section located under said operating member, an actuator rotatably supported to said housing for opening and closing said contact switch section, a spring retained between said actuator and said operating member, and a pusher pin extending downwardly from said operating member and adapted to push said actuator, wherein when said operating member is depressed to make said pusher pin abut against said actuator, said actuator starts to be rotated for generating the buckling of said spring.

With this arrangement, the rotation of the actuator is started by the abutment of the pusher pin against the actuator, and the buckling of the spring is generated by the rotation of the actuator. Accordingly, a timing of the abutment of the pusher pin against the actuator can be made constant with a given depression stroke of the key top, and the start-timing of the spring can be made constant at a given rotative position of the actuator. As a result, the timing of the contact switch section to be operated by the actuator can be made constant.

Other objects and features of the invention will be more fully understood from the following detailed description and appended claims when taken with the accompanying drawings.

DETAILED DESCRIPTION OF THE PREFERRED EMBODIMENT

Figure 2:
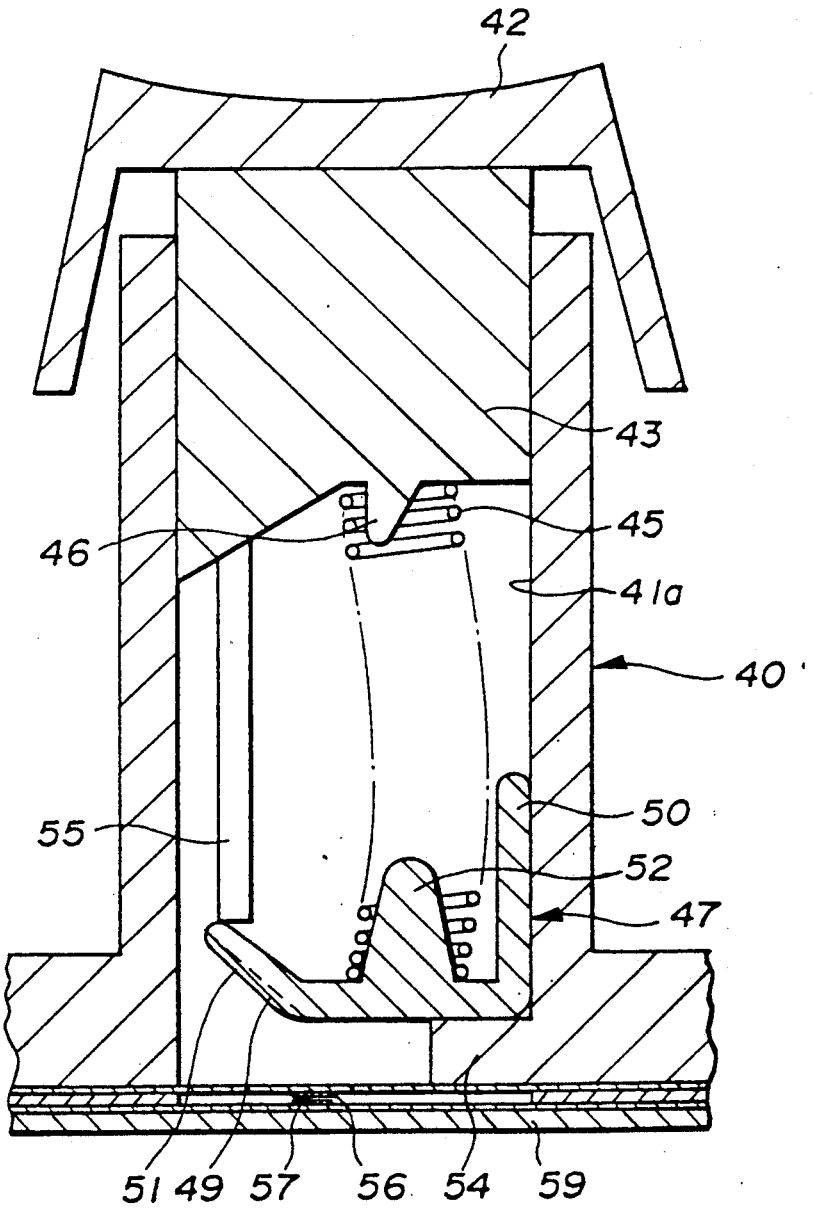
FIG. 2 is a view similar to FIG. 1, illustrating a condition where the key top is depressed to make the pusher pins abut against the actuator.
Figure 3:
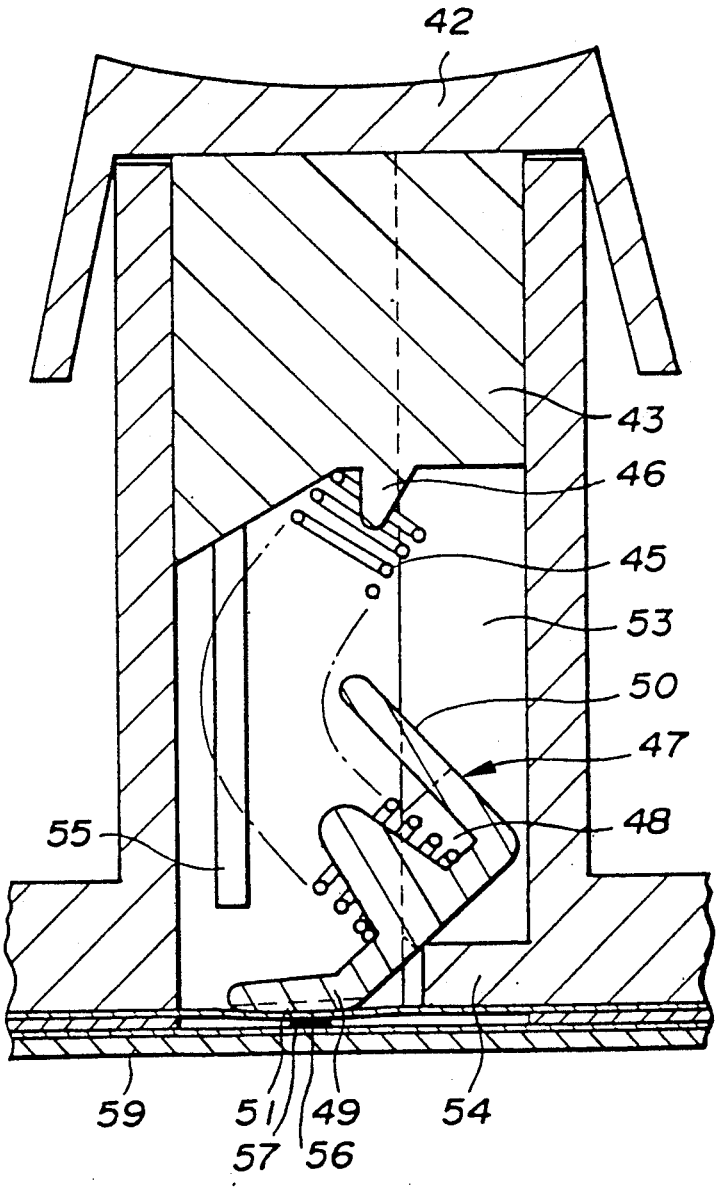
FIG. 3 is a view similar to FIG. 2, illustrating a condition where the key top is further depressed to rotate the actuator.
Figure 4:
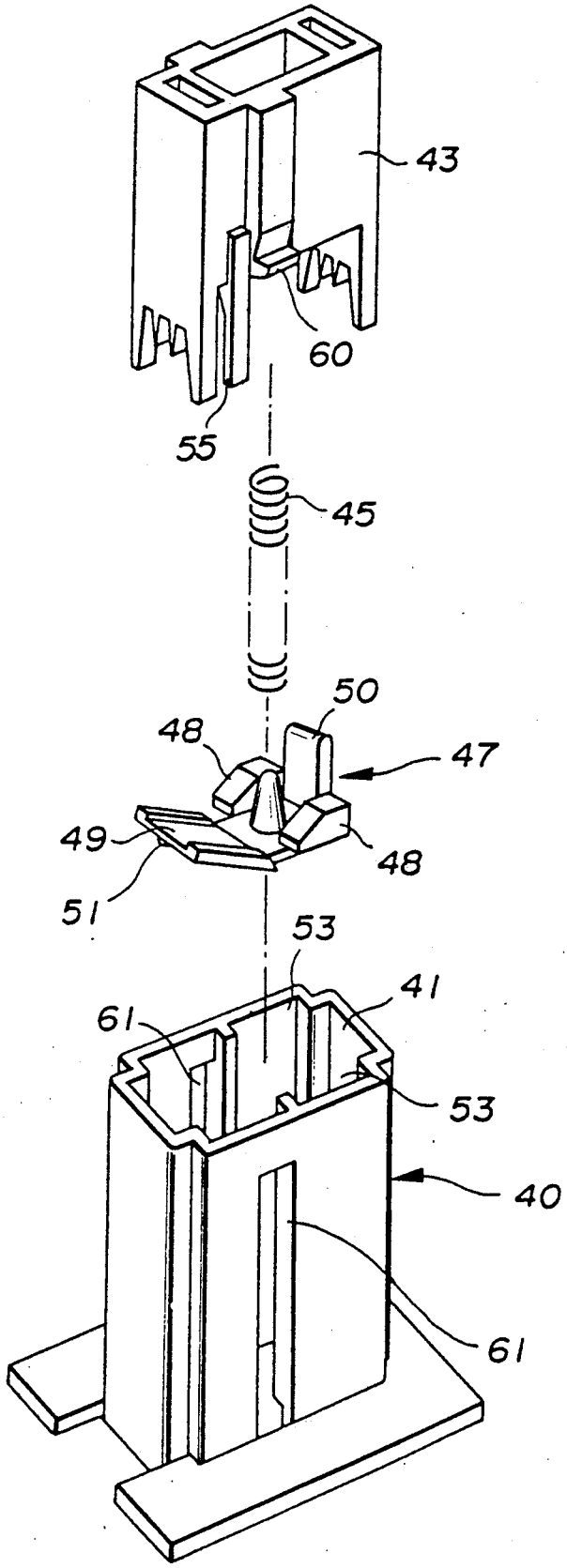
FIG. 4 is an exploded perspective view of the push button switch.
Figure 5B:
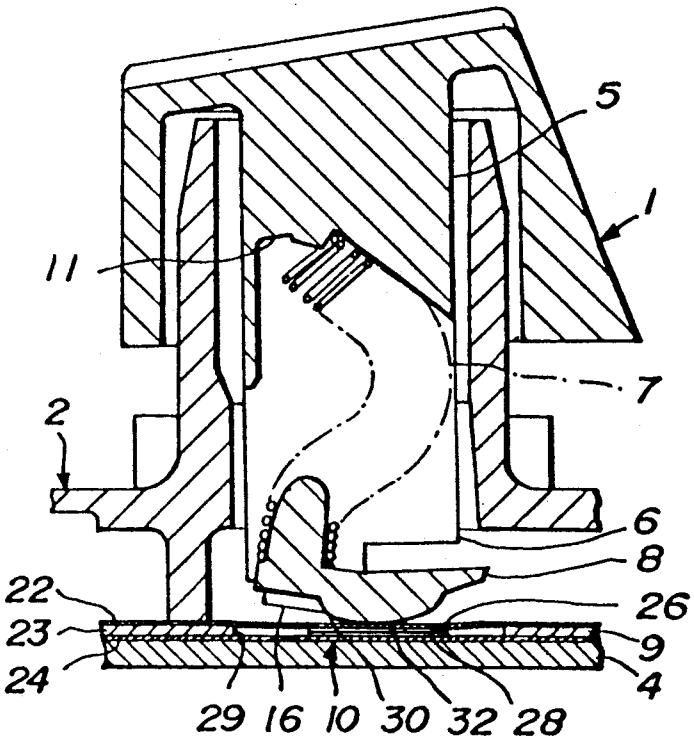
FIG. 5(b) PRIOR ART
FIG. 5B is a view similar to FIG. 5A, illustrating the depressed condition of the key top.
Figure 5A:
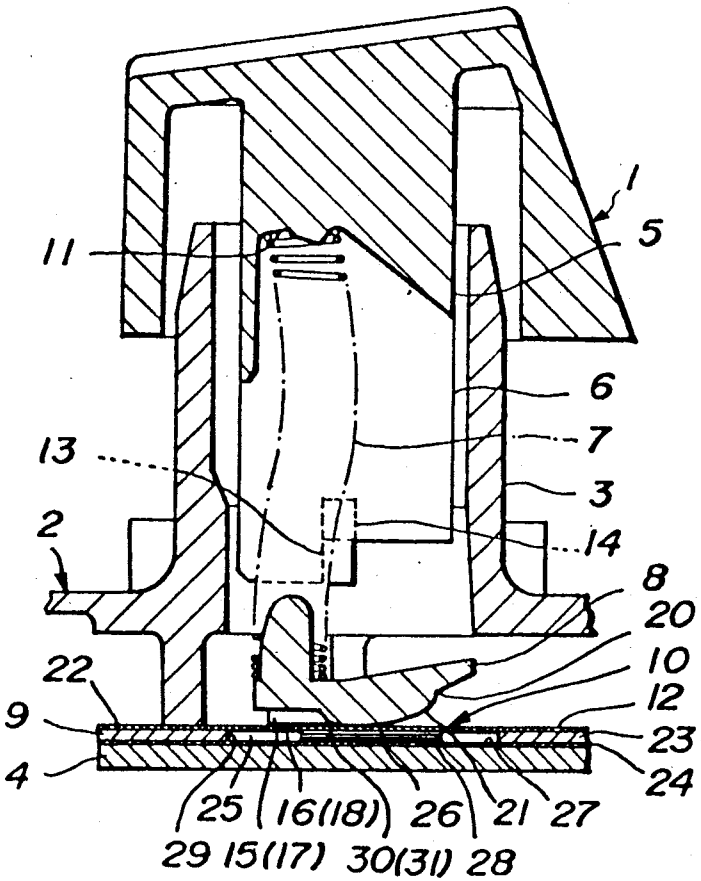
FIG. 5(a) PRIOR ART
FIG. 5A is a vertical sectional view of a push button switch in the prior art under the undepressed condition of the key top.

Referring to FIGS. 1 to 4, reference numeral 40 designates a housing of the push button switch according to the present invention. The housing 40 is formed with a hole 41 for vertically movably receiving a key top 42 as the operating member according to the present invention. The key top 42 is fixedly provided with a sliding portion (stem) 43 extending downwardly and slidably received in the hole 41 of the housing 40. The stem 43 is formed at its lower portion with a hole 44 for receiving an upper portion of a coil spring 45. The coil spring 45 is engaged at its upper end with a small projection 46 formed on an inside top surface of the stem 43 in the hole 44. As shown in FIG. 4, an actuator 47 is provided on its opposite sides with a pair of rotary shafts 48. The actuator 47 further includes first and second extensions 49 and 50 extending in a direction perpendicular to an axis of rotation of the rotary shafts 48. The first extension 49 is bent at its substantially central position to form an upward slant portion and a horizontal portion. The upward slant portion is formed on its lower surface with a projection 51 for pressing an upper electrode 56 which will be hereinafter described, while the horizontal portion is formed on its upper surface with a projection 52 for engaging a lower end of the coil spring 45. The projection 52 is located at a position offset from the axis of rotation of the rotary shafts 48. The second extension 50 extends vertically upwardly from a side edge of the horizontal portion of the first extension 49, and is normally disposed to abut against one of opposite side walls **41*a* of the hole 41 under a rest or undepressed condition of the key top 42, thereby restricting clockwise rotation of the actuator 47 from the rest position of the actuator 47. The rotary shafts 48 of the actuator 47 are received in a pair of recesses 53 formed on opposite side walls 41*b* of the hole 41, and the horizontal portion of the first extension 49 is disposed at its transversely central portion on a supporting projection 54 projecting inwardly from the side wall 41*a*** at a lower end thereof.

Figure 1:
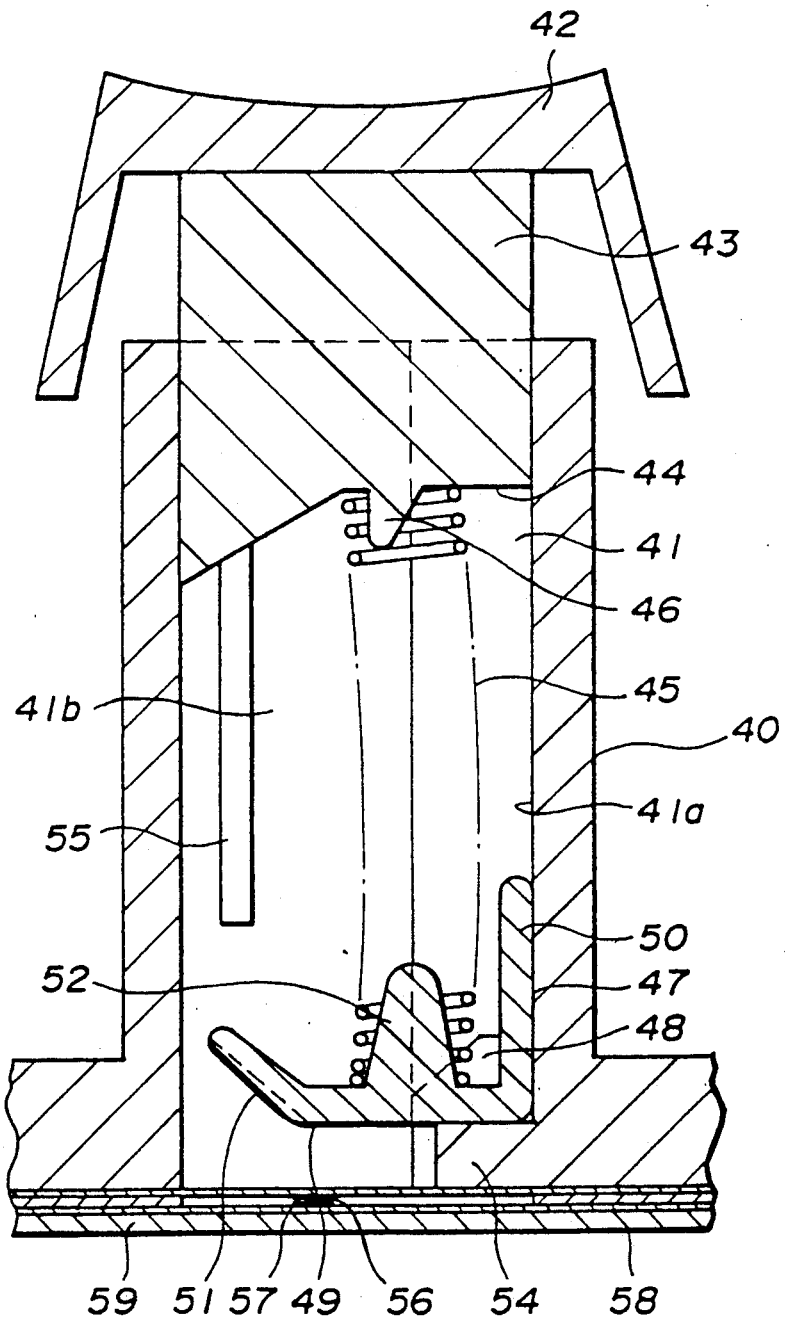
FIG. 1 is a vertical sectional view of the push button switch according to the present invention under the undepressed condition of the key top.

The stem 43 of the key top 42 is formed with a pair of pusher pins 55 extending downwardly and having lower ends adapted to abut against a free end of the first extension 49 of the actuator 47. Each of the pusher pins 55 has a length such that when the key top 42 is in the undepressed condition as shown in FIG. 1, the lower ends of the pusher pins 55 are separate from the free end of the first extension 49, and when the key top 42 is depressed to an extent such that the buckling of the coil spring 45 is not yet started as shown in FIG. 2, the lower ends of the pusher pins 55 comes to abutment against the free end of the first extension 49. Furthermore, when the key top 42 is further depressed to generate the buckling of the coil spring 45 as shown in FIG. 3, the lower ends of the pusher pins 55 are brought into separation again from the free end of the first extension 49, so that they may not reach the upper electrode 56 to be hereinafter described in detail.

A membrane switch section of the push button switch is constructed of the upper electrode 56 provided beneath an upper elastic membrane, a lower electrode 57 provided on a lower elastic membrane, a spacer 58 interposed between the upper membrane and the lower membrane except an area where the upper and lower electrodes 56 and 57 are disposed. The membrane switch section is retained on a base plate 59. As shown in FIG. 4, a pair of elastic stoppers 60 are formed on the opposite outer side surfaces of the stem 43, and they are slidably engaged with a pair of vertical slits 61 formed through the opposite side walls **41*b* of the housing 40, so that the stem 43 may be prevented from disengaging from the housing 40 with a vertical travel of the stem 43** being limited.

The operation of the preferred embodiment mentioned above will now be described.

When the key top 42 is in the undepressed condition as shown in FIG. 1, and the coil spring 45 is in a precompressed condition between the small projection 46 of the key top 42 and the projection 52 of the actuator 47, the actuator 47 is retained under such a condition that the bottom surfaces of the rotary shafts 48 of the actuator 47 are maintained in close contact with the lower end surfaces of the recesses 53 by a small biasing force of the precompressed coil spring 45. Accordingly, the projection 51 of the actuator 47 is separate from the upper electrode 56, and the upper electrode 56 is separate from the lower electrode 57. That is, the membrane switch section is normally open.

When the key top 42 is depressed from the rest condition shown in FIG. 1, the coil spring 45 is further compressed, and simultaneously the pusher pins 55 are moved downwardly to abut against the free end of the first extension 49 of the actuator 47 as shown in FIG. 2. As a result, the actuator 47 starts to be rotated counterclockwise about the axis of rotation of the rotary shafts 48. At this time, the buckling of the coil spring 45 is not yet generated.

Thereafter, when the key top 42 is further depressed, the free end of the first extension 49 of the actuator 47 is pushed by the lower ends of the pusher pins 55, and the actuator 47 is further rotated counterclockwise. At the same time, the coil spring 45 is further compressed and is simultaneously deflected laterally (leftwardly as viewed in FIG. 3) at its substantially central portion. During the further depression of the key top 42, when the reaction of the lateral deflection exceeds the reactions of the compression force of the coil spring 45 at its opposite ends, the buckling of the coil spring 45 is generated as shown in FIG. 3 to thereby obtain a click feeling. At this time, the free end of the first extension 49 of the actuator 47 comes to separation from the lower ends of the pusher pins 55, and the actuator 47 is further rotated counterclockwise about the axis of rotation of the rotary shafts 48 until the projection 51 of the first extension 49 urges the upper electrode 56 to bring the same into contact with the lower electrode 57 as shown in FIG. 3. Under the condition shown in FIG. 3, there is defined a sufficient gap between the lower ends of the pusher pins 55 and the upper electrode 56 such that even when the key top 42 is further depressed under this condition, the lower ends of the pusher pins 55 do not reach the upper electrode 56. Therefore, undue depression of the membrane switch section by the pusher pins 55 can be prevented.

When the depression force applied to the key top 42 is released under the condition shown in FIG. 3, the coil spring 45 is returned by its own spring force from the buckling condition to the original nearly straight condition, thereby lifting the key top 42 and simultaneously rotating the actuator 47 clockwise about the axis of rotation of the rotary shafts 48. That is, the key top 42 is lifted until the elastic stoppers 60 of the stem 43 are brought into engagement with the upper ends of the slits 61 of the housing 40. At the same time, the actuator 47 is rotated clockwise until the second extension 50 of the actuator 47 is brought into abutment against the side wall 41*a* of the housing 40. Accordingly, the projection 51 of the actuator 47 is brought into separation from the upper electrode 56, and the upper elastic membrane at the upper electrode 56 is returned to the original condition by its own elastic force, thus restoring a normal open condition of the membrane switch section.

As described above, the actuator 47 to be operated by depressing the key top 42 is started to be rotated by the pusher pins 55 of the stem 43. Therefore, both the time between depressing key 42 and rotation of the actuator 47, and the start-timing of the coil spring 45 can be accordingly made constant. As a result, the timing of the membrane switch can be made constant.

Further, when the membrane switch is turned on, there remains a gap between the lower ends of the pusher pins 55 and the upper electrode 56. Therefore, even when the key top 42 is excessively depressed after turning on the membrane switch, undue depression of the membrane switch by the pusher pins 55 can be prevented.

Furthermore, since the buckling of the coil spring 45 is forcibly started by pushing the free end of the first extension 49 of the actuator 47 by the pusher pins 55 and rotating the actuator 47, the timing of the membrane switch is not affected by variations of the spring force of the coil spring 45.

Furthermore, even when the key top 42 is depressed at its edge, it is smoothly moved down to make the pusher pins 55 push the actuator 47. Therefore, the click feeling can be reliably obtained at a constant timing.

The coil spring 45 may be replaced by any other spring members such as a leaf spring according to the present invention.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. A push button switch comprising:

a switch housing;

an operating member slideably received in said housing, wherein sliding said operating member in a first direction a certain distance into said housing actuates said switch;

a substantially cylindrical shaped spring means having a first end contacting said operating member and extending within said housing so that sliding said operating member in said first direction initially compresses said spring means;

a rocker element having first and second arms, said rocker element being located within said housing, said rocker element being pivotable about a pivot point such that said first arm and said second arm move in substantially opposite directions when said rocker arm pivots about said pivot point, said spring means having a second end contacting said rocker element proximate to said pivot point such that said rocker element is in a substantially non-tilted position when said operating member is at a substantially fully extended normal position, said second arm being arranged on said rocker element so as to be substantially parallel to said cylindrical shaped spring means, said second arm contacting an inner wall of said housing when said rocker element is in said substantially non-tilted position to restrict said rocker element from tilting in a first direction;

a push pin connected to said operating member and extending within said housing, said push pin not contacting said first arm of said rocker element when said operating member is in said fully extended normal position, said push pin contacting said first arm of said rocker element when said operating member is displaced a first distance into said housing by a force applied to a first end of said operating member so as to cause said rocker element to initially tilt a first amount in a second direction, opposite to said first direction, due to a force applied to said first arm by said push pin, said push pin causing said rocker element to have an increased tilt when said operating member is displaced by a second distance so as to cause said spring means to buckle due to said increased tilt of said rocker element, wherein buckling of said spring means causes said rocker element to fully tilt without additional depression of said operating member; and electrical contacting means being actuated by said rocker element when said rocker element is in its fully tilted position, said electrical contacting means for making or breaking an electrical circuit.

2. The switch of claim 1 wherein said pivot point is an edge of a shelf formed in said housing, said shelf having a top surface which supports said rocker element in its non-tilted position.

* * * * *